US005752902A

United States Patent [19]

Walker

[11] Patent Number: 5,752,902

[45] Date of Patent: May 19, 1998

[54] COLLAPSIBLE EXERCISE DEVICE AND METHOD

[76] Inventor: Robert A. Walker, 980 10th Ave. NE., Naples, Fla. 34120

[21] Appl. No.: 810,519

[22] Filed: Mar. 3, 1997

[51] Int. Cl.[6] ..... A63B 26/00

[52] U.S. Cl. ..... 482/140; 482/142; 482/145; 482/95

[58] Field of Search ..... 482/95, 131, 132, 482/140, 142, 145

[56] References Cited

U.S. PATENT DOCUMENTS

| | | | |
|---|---|---|---|
| D. 210,083 | 2/1968 | Werner | 482/142 |
| 2,724,428 | 11/1955 | Sellner | 482/142 |
| 2,759,730 | 8/1956 | Berry | 482/145 |
| 3,043,591 | 7/1962 | Sellner | 482/142 |
| 3,075,518 | 1/1963 | Sellner | 482/142 |
| 4,282,868 | 8/1981 | Riggs | 482/131 |
| 5,215,511 | 6/1993 | Cheng | 482/142 |
| 5,545,114 | 8/1996 | Gvoich | 482/140 |
| 5,567,202 | 10/1996 | Hager | 482/140 |
| 5,665,041 | 9/1997 | Hsieh | 482/142 |

*Primary Examiner*—Lynne A. Reichard
*Attorney, Agent, or Firm*—American Innovations, Inc.

[57] ABSTRACT

A collapsible exercise device having three U-shaped frame members pivotally connected at one pivot point, and each frame member being connected between free swingable portions by straps. A foot shaft is pivotally connected to a base frame member, and is also connected by a strap to the swingable portion of a middle frame member. A user positions himself on a floor or level surface within the apparatus, using his legs to depress the foot shaft, and creating tension on the straps, which pivots the frame members at the pivot point, thus lifting the head and torso therewith. The user exercises by alternatively depressing the foot shaft to lift up the head and torso into an engaged position, and then releasing pressure on the foot shaft to return the head and torso to a rest position.

8 Claims, 3 Drawing Sheets

COLLAPSIBLE EXERCISE DEVICE AND METHOD

BACKGROUND OF THE INVENTION

1. Field of the Invention

This invention relates to exercise devices generally used for exercising and stretching a user's back and abdomen, particularly a collapsible exercise device having three U-shaped frame members pivotally connected at one pivot point, and each frame member being connected between free swingable portions by straps. A foot shaft is pivotally connected to a base frame member, and is also connected by a strap to the swingable portion of a middle frame member. A user positions himself on a floor or level surface within the apparatus, using his legs to depress the foot shaft, and creating tension on the straps, which pivots the frame members at the pivot point, thus lifting the head and torso therewith. The user exercises by alternatively depressing the foot shaft to lift up the head and torso, and then releasing pressure on the foot shaft to return the head and torso to a rest position.

2. Discussion of the Prior Art

| | |
|---|---|
| BUONI | 4,902,003 |
| JOHNSON | 5,033,742 |
| EVANS | 5,120,052 |
| STEARNS | 5,346,447 |
| GVOICH | 5,545,114 |

EVANS and GVOICH both disclose devices for strengthening abdominal muscles using feet or legs. Buoni teaches the use of a curved apparatus that rocks forwardly and backwardly to exercise abdominal muscles, while Stearns and Johnson both show exercise devices that provide limited back support. None of the prior art, however, shows a back and abdomen exercise device having a collapsible, pivotal frame, allowing a sit-up type of motion to be aided by depressing a foot shaft pivotally mounted on the base of the frame.

SUMMARY OF THE INVENTION

Accordingly, it is an important object of the present invention to provide an exercise device that is easily collapsible for storage purposes, and lightweight for ease of use.

It is also an important object of the invention to provide an exercise device that allows a user to perform a full sit-up type of motion aided by the user's leg muscles depressing a foot shaft, so that the user is not required to exert the full effort required to perform a sit-up unaided by any mechanical device.

It is another important object of the present invention to provide a method for strengthening back and abdomen muscles through repetitive sit-up style motions within a collapsible exercise device by using leg muscles as a complemental force together with the abdomen and back muscles to aid with the sit-up motion.

It is yet another object of the present invention to provide an apparatus and method for exercising back and abdomen muscles that does not require the assistance of a user's arms, wherein the exercise may be performed using the abdomen, back and leg muscles.

DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENTS

Figure 1:
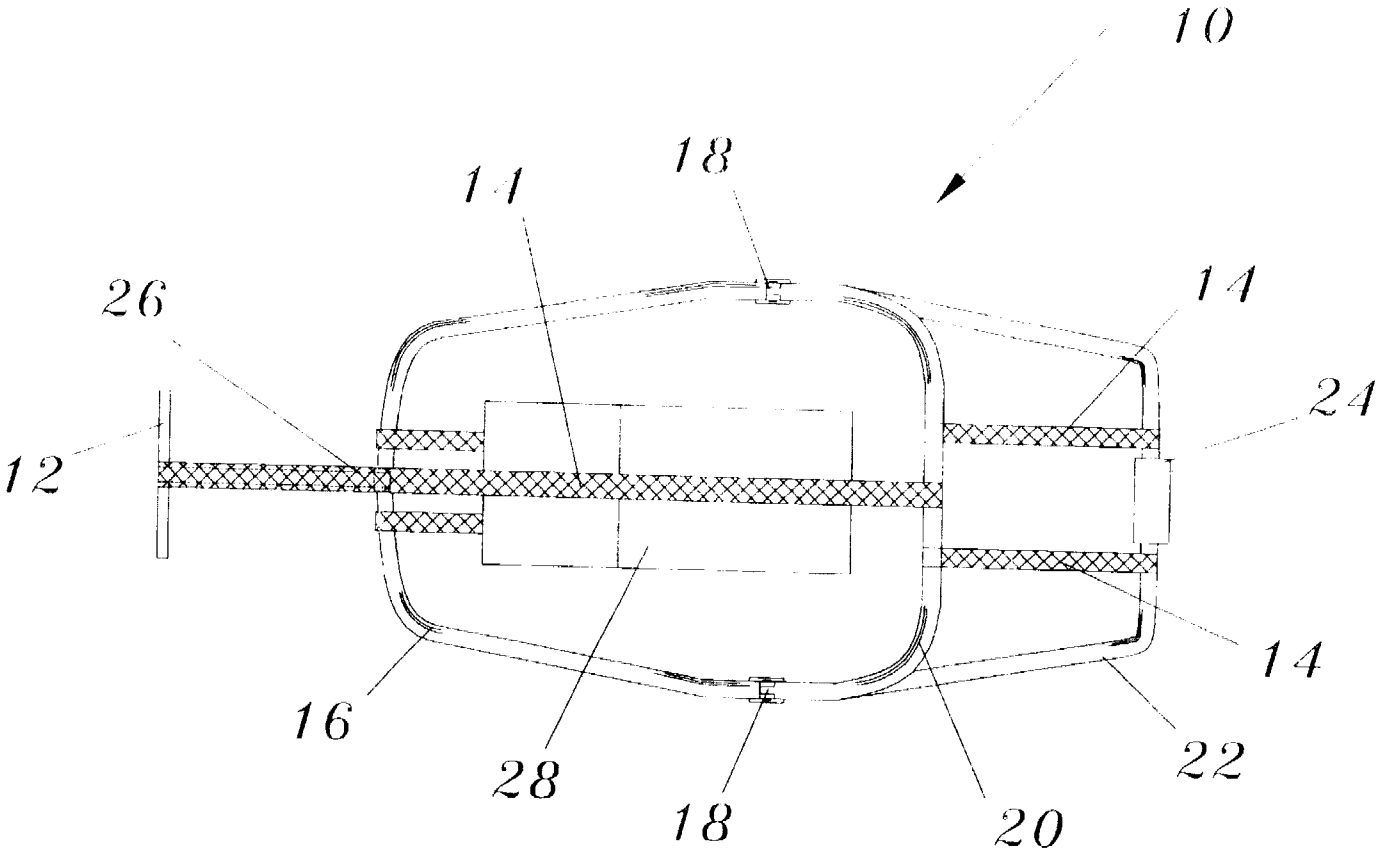
FIG. 1 is a top view, illustrating the collapsible exercise apparatus in the open, resting position ready for use.

In FIG. 1, the collapsible exercise device is shown generally at 10. The generally U-shaped base frame member 16 is illustrated as having two opposed ends, each end forming a pivot point 18. A foot shaft 26 is pivotally attached midway between the opposed ends of the base frame member 16. A foot engagement member 12 is mounted at the free end of the foot shaft 26. The foot shaft is connected at its free end to the middle frame swivel 20 by a strap 14. The middle frame swivel 20 is generally U-shaped with two opposed ends, which are pivotally attached to the base frame member 16 at the pivot points 18. The middle frame swivel rotates about the pivot points, and has a free swinging portion opposite the pivot points. A bottom frame swivel member 22 is generally U-shaped, having two opposed ends which are pivotally attached to the base frame member at the pivot points, thus creating a free swinging portion opposite the pivot points. In a preferred embodiment, a headrest 24 is mounted at the free swinging portion of the bottom frame swivel member.

A back support member 28 is shown disposed adjacent the base frame member for supporting a user's back during an exercising session. Although the back support member may be made from any suitable material, it is contemplated that the back support member be made from wood with a foam padding covering the wood.

A strap 14 is used to connect the foot shaft 26 with the free swinging portion of the middle frame swivel 20. A pair of straps 14 are used to connect the free swinging portion of the bottom frame swivel member 22, adjacent the headrest 24, to the free swinging portion of the middle frame swivel 20.

Figure 2:
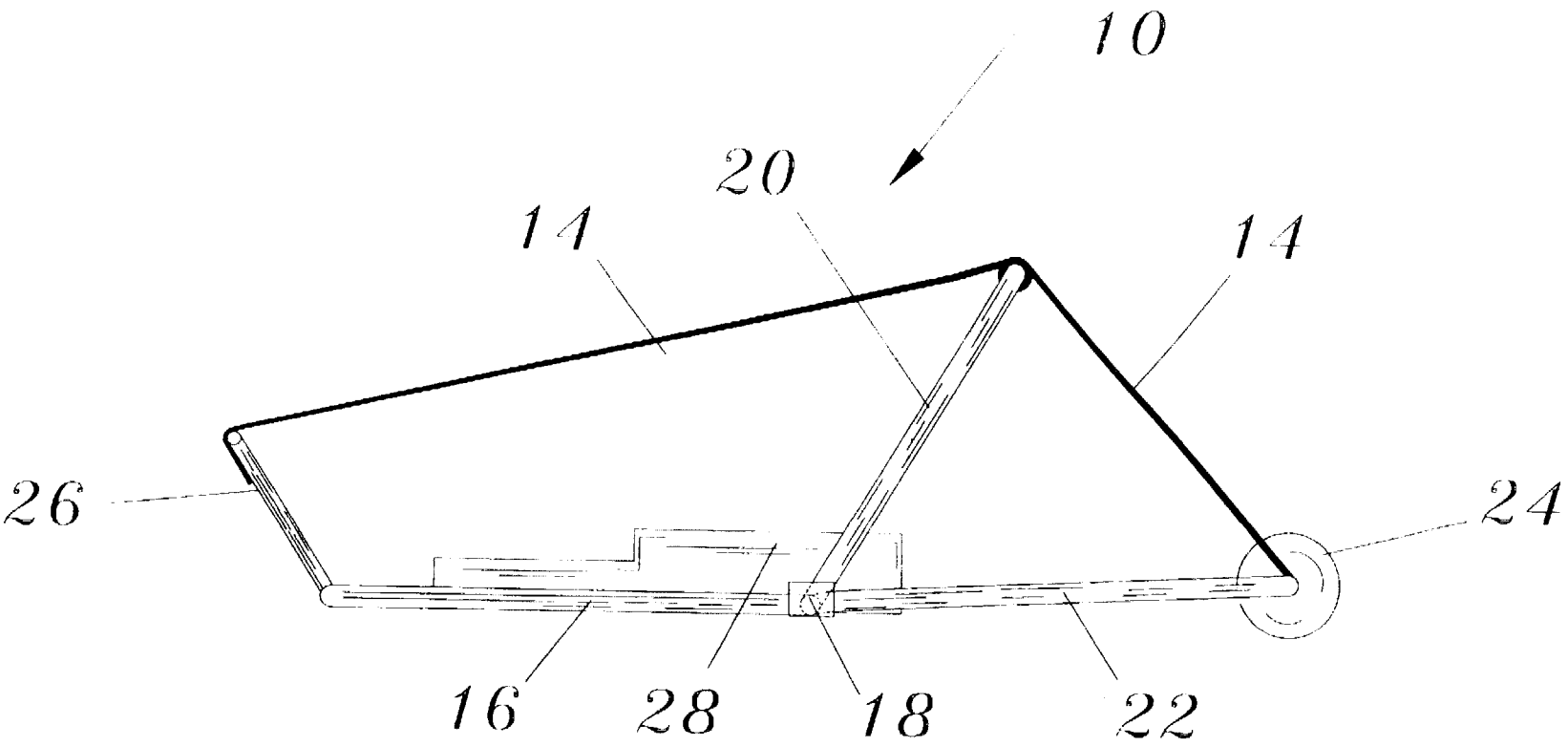
FIG. 2 is an elevated side view, illustrating the collapsible exercise apparatus in the open, resting position ready for use.

In FIG. 2, the base frame member 16 is shown on a level surface, and the collapsible exercise device is shown in the open position ready for use. The middle frame swivel 20 is shown on one side pivotally attached to the base frame member 16 at a pivot point 18. The bottom frame swivel member 22 is shown pivotally attached at the pivot point 18 to the base frame member 16. A headrest 24 is mounted at the free swinging portion of the bottom frame swivel member. A pair of straps 14 (only one shown) are attached between the free swinging portions of the middle frame swivel and the bottom frame swivel member. Another strap is shown connecting the free swinging portion of the middle frame swivel and the free end of the foot shaft 26. The foot shaft is shown to be pivotally attached to the base member between the pivot points (only one shown).

Figure 3:
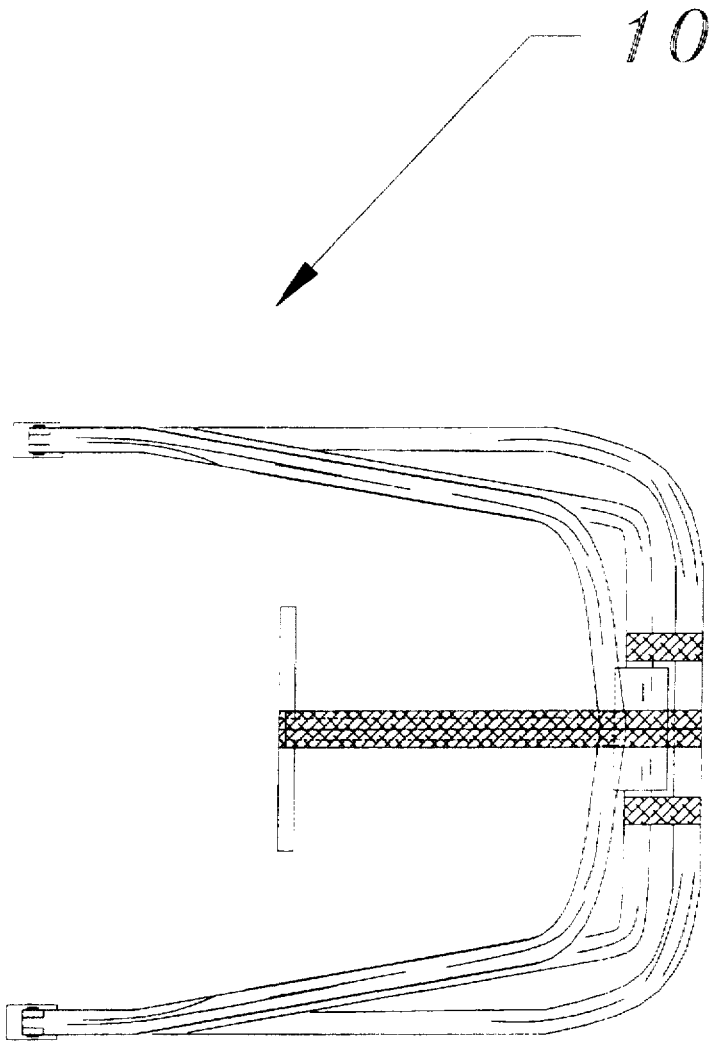
FIG. 3 is a front view of the collapsible exercise apparatus in the folded storage position.

In FIG. 3, the collapsible exercise apparatus 10 is shown in the folded storage position. By folding the foot shaft down so that it is parallel with the base frame member, and then folding the bottom frame swivel member and the middle frame swivel down so that it is parallel with the base frame member, the user may collapse the apparatus into the folded storage position. This feature allows the apparatus to be stored in a minimal amount of space.

To use the apparatus, a user positions the apparatus on a generally level surface in the open position, as shown in FIGS. 1 and 2. The user then positions himself with his back on the back support so that his feet are engaged with the foot engagement member 12 and his head is resting on the headrest 24. By depressing the foot engagement member with his feet, the tension on the straps is increased, which pivotally rotates the middle frame swivel and the bottom frame swivel member, thus raising the user's head and torso into the engaged position. The user then gently releases the pressure on the foot engagement member, allowing his head and torso to slowly come to rest in the rest position. By repeatedly depressing and releasing the pressure on the foot engagement member, the user exercises his back and abdomen.

The instant apparatus allows a person to exercise the abdomen and back without having to exert the full force required to perform a sit-up unaided. By using the leg muscles to assist in the sit-up motion, the user is not required to exert the usual energy and strength to do a regular sit-up, thus increasing the normal exercise time and decreasing the possibility of exercise induced injury, particularly to the back and abdomen muscles.

While a preferred embodiment of the invention has been described using specific terms, such description is for illustrative purposes only, and it is to be understood that changes and variations may be made without departing from the spirit or scope of the following claims.

What is claimed is:

1. A collapsible exercise device for strengthening and stretching a person's back and abdomen, said exercise device comprising:

a generally U-shaped base frame member having two opposed ends, each of said opposed ends forming a pivot point;

a generally U-shaped middle frame swivel having two opposed ends pivotally attached to said pivot points, and having a free swinging portion disposed between said opposed ends;

a generally U-shaped bottom frame swivel having two opposed ends pivotally attached to said pivot points, and having a free swinging portion disposed between said opposed ends;

a foot shaft pivotally attached to a center of said base frame member, said foot shaft having foot engagement members at a free end;

means connecting free end of said foot shaft and said free swinging portion of said middle frame swivel;

means connecting said free swinging portions of said middle frame swivel and said bottom frame swivel.

2. The structure set forth in claim 1, further including a padded back support member positioned between said base frame member and said bottom frame swivel.

3. The structure set forth in claim 1, further including a headrest mounted on said free swinging portion of said bottom frame swivel.

4. The structure set forth in claim 1, wherein said connecting means are straps.

5. A method for exercising, strengthening and stretching a person's back and abdomen muscles, said method comprising the steps of:

providing a collapsible exercise device having a generally U-shaped base member having two opposed ends each forming a pivot point pivotally connected to opposed ends of both a generally U-shaped middle frame swivel and a generally U-shaped bottom frame member, each of said swivel members also having a free swinging portion connected therebetween by a first connecting means;

providing a foot shaft pivotally connected from a center portion of said base member, said foot shaft connected at a free end to said free swinging portion of said middle frame swivel by a second connecting means;

unfolding said collapsible exercise device from a folded storage position and setting said base frame member on a generally level surface;

positioning a user's body so that the user's feet are engaged with said foot shaft, and user's head is supported by a central portion of said bottom frame swivel;

performing a repetitive routine of utilizing user's feet to depress said foot shaft creating tension on said straps and pivotally lifting both middle frame swivel and bottom frame swivel into an engaged position, also lifting said user's head and torso pivotally into said engaged position, and then releasing pressure of said feet on said foot shaft allowing said middle frame swivel and bottom frame swivel to gently return to a resting position;

continuing said repetitive routine as long as desired;

dismounting from said exercise device;

folding said exercise device into said folded storage position; and storing said exercise device.

6. The method set forth in claim 5, including the step of providing straps as said first and second connecting means.

7. The method set forth in claim 5, further including the step of providing a headrest at said free swinging portion of said bottom frame swivel member.

8. The method set forth in claim 5, further including the step of providing a back support member positioned on said level surface between said base frame member and said bottom frame swivel member.

* * * * *